US005510768A

United States Patent [19]

Mann

[11] Patent Number: 5,510,768

[45] Date of Patent: Apr. 23, 1996

[54] ALARM STRAP FOR LUGGAGE

[76] Inventor: Glenn E. Mann, 122 Sherlake Rd., Knoxville, Tenn. 37922

[21] Appl. No.: 321,322

[22] Filed: Oct. 11, 1994

[51] Int. Cl.[6] ..... G08B 13/14; A45C 13/10

[52] U.S. Cl. ..... 340/571; 190/25; 190/101; 190/119; 190/120

[58] Field of Search ..... 340/571; 190/25, 190/26, 101, 102, 118, 119, 120

[56] References Cited

U.S. PATENT DOCUMENTS

| | | | |
|---|---|---|---|
| 244,129 | 7/1881 | Hoff | 190/25 |
| 548,887 | 10/1895 | Murphy . | |
| 1,119,193 | 12/1914 | Roth . | |
| 1,171,042 | 2/1916 | Greytak . | |
| 1,288,909 | 12/1918 | Jones . | |
| 3,628,640 | 12/1971 | Molnar | 190/120 |
| 3,656,144 | 4/1972 | Forte | 340/283 |
| 3,701,140 | 10/1972 | Dixon | 340/283 |
| 4,155,079 | 5/1979 | Chiu et al. | 340/571 |
| 4,188,622 | 2/1980 | Miller et al. | 340/571 |
| 4,204,202 | 5/1980 | Pai | 340/571 |
| 4,267,553 | 5/1981 | Vagelsanger et al. | 340/571 |
| 4,272,763 | 6/1981 | Chang et al. | 340/571 |
| 4,340,007 | 7/1982 | Hogan | 116/81 |
| 4,685,315 | 8/1987 | Comolli | 190/120 |
| 4,700,818 | 10/1987 | Orwin | 190/26 |
| 4,755,802 | 7/1988 | Urbanczyk | 340/571 |
| 5,032,823 | 7/1991 | Bower et al. | 340/568 |
| 5,043,702 | 8/1991 | Kuo | 340/539 |
| 5,068,642 | 11/1991 | Hruby et al. | 340/562 |
| 5,075,671 | 12/1991 | Livingston III | 340/574 |
| 5,099,228 | 3/1992 | Israel et al. | 340/572 |
| 5,108,019 | 4/1992 | Woodward et al. | 224/243 |
| 5,164,706 | 11/1992 | Chen | 340/571 |
| 5,191,314 | 3/1993 | Ackerman et al. | 340/542 |
| 5,247,353 | 9/1993 | Cho et al. | 358/105 |
| 5,255,765 | 10/1993 | Schrecongost | 190/26 |

*Primary Examiner*—John K. Peng
*Assistant Examiner*—Albert K. Wong
*Attorney, Agent, or Firm*—Pitts & Brittian

[57] ABSTRACT

An alarm strap for luggage (10) for emitting an audible alarm when unauthorized entrance into baggage (34) is attempted. The alarm strap for luggage (10) includes an alarm housing (12), alarm circuitry (14), a lock switch (24), and a strap (26), made of substantially the same material of typical luggage straps, carrying an electrically conductive element (28). A ratcheting mechanism (30) is attached to the alarm housing (12). The strap (26) is wrapped around the baggage (34), passed through the ratcheting mechanism (30), and tightened down so that no slack is left, and the strap (26) is taut against the baggage (34). The lock switch (24) is turned to the on position to complete the alarm circuitry (14) circuit and arm the alarm. When someone tries to gain unauthorized access to the baggage (34) by cutting the strap (26), the severing of the electrically conductive element (28) energizes the alarm circuitry (14) and sets off an audible alarm.

13 Claims, 3 Drawing Sheets

ALARM STRAP FOR LUGGAGE

TECHNICAL FIELD

This invention relates to the field of alarm devices. More specifically, the present invention relates to alarm devices for use on baggage such as purses and luggage. This invention provides an easily deployed strap for circumscribing the baggage so that when the strap is removed without the alarm being disarmed an alarm will sound.

BACKGROUND ART

It is common knowledge that baggage such as purses and luggage are often the objects of thieves. In the past, the main focus of foiling such thieves has been on locks and other devices which impede entry into the baggage. The problem with mere locks is that the lock itself does nothing to deter the thief from taking and opening the baggage; the lock merely slows the thief's entry into the baggage. In other words, locks do not scare the thieves away; they merely delay the time in which the thieves gain access to the stolen goods.

One way to scare a thief away is with an audible alarm. Many inventions exist which sound an alarm if unauthorized access to the object is attempted. One such known invention is U.S. Pat. No. 5,164,706, issued to Yoky Chen on Nov. 17, 1992. Chen teaches a sensor to be placed on luggage which sounds an alarm if someone or something gets too close to the baggage. However, the Chen alarm sounds if anything gets within this range. This would include other baggage. Since the baggage may be in close proximity to other baggage in the cargo hold of a plane, for instance, the owner would have to disable the alarm while it is in the cargo hold. However, a thief might intercept the baggage after the owner disarms the alarm.

Another known invention, U.S. Pat. No. 3,701,140, issued to Richard W. Dixon on Oct. 24, 1972, sets off an alarm when the baggage is pulled from the owner's grasp. Unfortunately, this means that the owner must be in direct danger for an alarm to sound. In addition, the alarm will not be activated if the baggage is merely picked up off of a counter or conveyor belt. Nor does an alarm sound when an unauthorized person opens the baggage.

An invention by Chun-Chang Kuo, U.S. Pat. No. 5,043,702, issued on Aug. 27, 1991, tries to solve the problem with an approach opposite to that of the Chen invention. In the Kuo invention, when the owner gets too far away from the baggage, an alarm sounds. However, much like the Chen invention, the drawback with the Kuo invention is that an owner often must be far away from the bag, as when it is in a cargo hold. At these times, to prevent annoying, false alarms, the owner must disable the alarm. This, however, leaves the bag vulnerable when it most needs protection, that is when it is out of the owner's sight as well as control.

To solve these types of problems, inventions in other fields have utilized cables to be wrapped around objects. When the cable or other connection is broken, as when entry is forced, an alarm sounds. For instance, in U.S. Pat. No. 5,108,019, issued to Terry D. Woodward and Brenda G. Woodward on Apr. 28, 1992, a gun holster is equipped with a strap which snaps closed to keep the gun secure in the holster. The snapped strap completes a circuit which, when broken to remove the gun, sounds an alarm. Such a device, which merely snaps closed, still makes entry into the compartment to be protected much too easy. A thief could have the strap unsnapped and the contents removed before anyone could respond to an alarm.

Another known invention utilizing a strap is U.S. Pat. No. 4,188,622, issued to Lawrence G. Miller and Rowland B. Purmal on Feb. 12, 1980. Miller, et.al., teaches a strap which is considerably harder to remove. This strap, however, fits around a garbage can. The Miller strap does not impede entry. In fact, the alarm of the Miller invention can only sound if the alarm is placed on a garbage can made of an electrically conductive material and if the strap itself is struck with enough force to depress the strap against the can, as if the can is tipped over. While this may work to keep animals from tipping the can over, the device sounds no alarm if a deliberate attempt is made to remove the lid and take any of the contents.

Two other inventions sound an alarm if a circuit or strap is broken, U.S. Pat. No. 5,099,228, issued to Marcia Israel and Leo R. Close on Mar. 24, 1992, and U.S. Pat. No. 5,032,823, issued to Davis S. Bower, Ronald C. Davies, and Donald E. Garee on Jul. 16, 1991. Israel, et. al., teaches a pin stuck through clothing which completes the circuit when the pin is then secured in a tag. While this invention does sound a remote alarm when someone tampers with the tag, the invention does not suggest that it is for keeping an object closed. In fact, it is designed to be unobtrusive so that a customer may try on the clothing and not be bothered by the tag.

Bower, et. al., does teach a strap which, when broken, sounds an alarm. However, this strap is to be used on the wrist or ankle of a person who is subject to house arrest. Once again, as with Israel, et. al., Bower does not teach a strap which also keeps something closed.

The two known inventions which, until now, best address these problems are U.S Pat. No. 4,340,007, issued to Paul Hogan on Jul. 20, 1982, and U.S. Pat. No. 5,191,314, issued to Roger C. Ackerman, Robert B. Jones, Kenneth A. Tarlow, and Eric Dennison on Mar. 2, 1993. Both Hogan and Ackerman, et. al., teach a device in which the cable is conductive and completes the circuit. When the cable is cut, the circuit is broken and an alarm sounds. In both, cutting or breaking of the cable is rendered considerably harder by the material of which the cable is composed. In addition, in both of these inventions, the end of the cable which is properly removed by an authorized entrant is locked down when the alarm is enabled.

However, both Hogan and Ackerman, et. al., have drawbacks if used with baggage. For instance, the cables of both are of fixed length. Unless the cable is providently dimensioned to fit around the baggage an integral number of times, there will be considerable slack in the cable. This could at least cause the cable to be snagged while the baggage is moving and at worst make the cable and alarm simply slip off of the baggage. In addition, a cable of the type in these inventions does not aesthetically match most baggage.

Therefore, it is an object of this invention to provide an alarm which impedes entry and sounds in the event of an unauthorized entry into the baggage.

Another object of the invention is to provide an alarm which need not be used in conjunction with electrically conductive baggage.

One more object of the present invention is to prove an alarm strap which can be dimensioned to fit snugly around baggage.

Yet another object of the present invention is to make the alarm strap aesthetically match the baggage on which it is used.

An additional object of the present invention is to secure the baggage in its closed position.

DISCLOSURE OF THE INVENTION

Other objects and advantages will be accomplished by the present invention which provides a strap to be secured around baggage and an alarm which sounds if the strap is removed or cut during unauthorized entry. The alarm strap of the present invention includes an alarm housing, alarm circuitry, a lock switch, a strap carrying an electrically conductive element, and, in one embodiment, a ratcheting mechanism to take up slack in the strap when the strap is secured around the baggage. An exterior portion of the alarm housing carries a ratcheting mechanism through which the strap is looped after being secured around the baggage. The ratcheting mechanism removes any slack in the strap. The alarm circuitry includes a power source, a signal generator, a speaker, and a continuity detection circuit which detects the breakage of the electrically conductive element in the strap. The strap is a substantially flat piece of webbing or other suitable material much like the material commonly used to make the straps on luggage. Carried by the strap and running the length of the strap is an electrically conductive element. This electrically conductive element completes the continuity detection circuit. The baggage owner uses the alarm strap for luggage by first looping the strap around the luggage. The free end of the strap is passed through the ratcheting mechanism on the alarm housing. The strap is secured and any slack is removed by tightening the ratcheting mechanism until the strap is taut around the baggage. The ratcheting mechanism locks so that the alarm can not be circumvented simply by slipping the strap back through the ratcheting mechanism. The removal of slack in the strap by the ratcheting mechanism also insures that a thief can not bypass the alarm simply by slipping the slack strap off of the baggage. The user arms the alarm strap for luggage by closing the lock switch which completes the alarm circuitry circuit.

When anyone tries to gain access to the interior of the baggage by cutting the strap, the electrically conductive element will be broken. This will cause the continuity detection circuit to signal that the strap has been broken. This will complete the alarm circuitry circuit. When the alarm circuitry circuit is completed, an audible alarm will be sounded from the signal generator through the speaker.

BRIEF DESCRIPTION OF THE DRAWINGS

The above mentioned features of the invention will become more clearly understood from the following detailed description of the invention read together with the drawings in which:

FIG. 4 particularly illustrates the electrically conductive element carried in the strap;

BEST MODE FOR CARRYING OUT THE INVENTION

Figure 1:
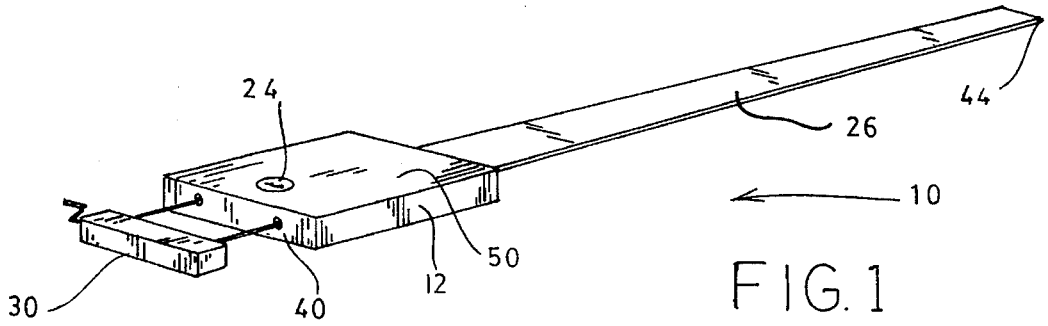
FIG. 1 is a perspective view of the alarm strap for luggage constructed in accordance with several features of the present invention showing the alarm strap for luggage before it is secured around the baggage.

An alarm strap for luggage incorporating various features of the present invention is illustrated generally at 10 in the figures. The alarm strap for luggage 10 is designed to provide a strap 26 which, when secured around a piece of baggage 34, will look substantially like other straps used on baggage 34. When the user arms the alarm strap for luggage 10 by securing the lock switch 24, an alarm will sound if someone cuts or breaks the strap 26 in an attempt to gain entry into the baggage 34.

In the preferred embodiment of the present invention, the alarm strap for luggage includes an alarm housing 12, alarm circuitry 14, a lock switch 24, a strap 26, and a ratcheting mechanism 30.

Figure 2:
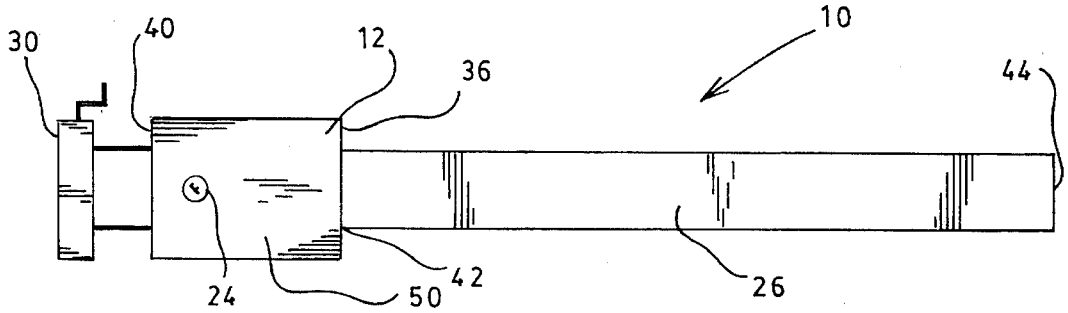
FIG. 2 illustrates a top plan view of the alarm strap for luggage of FIG. 1.
Figure 3:
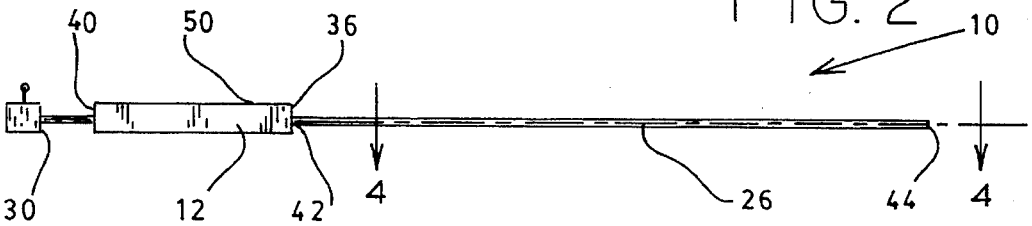
FIG. 3 is a side elevation view of the alarm strap for luggage of FIG. 1.
Figure 4:
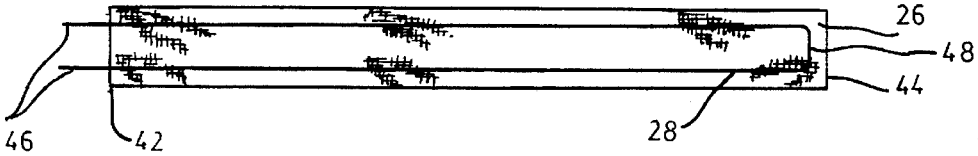
FIG. 4 illustrates a top plan view, in section, of the strap of the alarm strap for luggage taken at 4—4 of FIG. 3.
Figure 8:
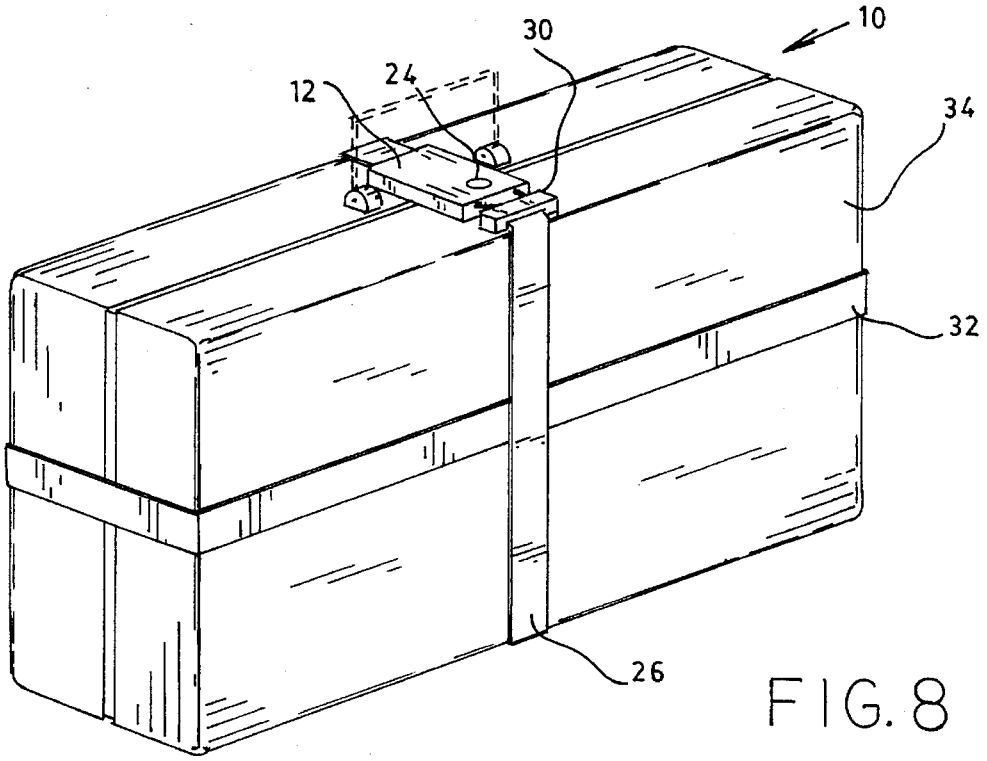
FIG. 8 illustrates a perspective view of an alternate embodiment of the alarm strap for luggage secured to a piece of luggage wherein a second strap is also used.

The strap 26 of the preferred embodiment is made of a material substantially like the material or webbing from which a typical luggage strap is made. The strap 26 defines a first end 42 and a second end 44 as shown in FIGS. 2, 3, and 4. The strap 26 is to be wrapped around the baggage 34 and will help keep the baggage 34 in a closed position. In an alternate embodiment, a second strap 32 is also used as shown in FIG. 8. The second strap 32 is substantially perpendicular to the first strap 26. The second strap 32 may be secured to the first strap 26 or may be integral with the first strap 26.

Figure 5:
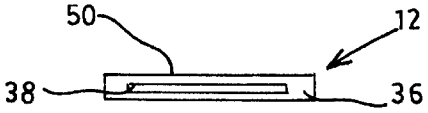
FIG. 5 illustrates a side elevational view of the alarm housing showing particularly the opening through which the strap extends to complete the continuity detection circuit.

The preferred embodiment also comprises an alarm housing 12, as shown in FIGS. 1, 2, 3, and 5, which carries the alarm circuitry 14. The alarm housing 12 is a substantially box-like apparatus preferably made of a strong material such as stainless steel or hardened plastic. The alarm housing 12 has a first side 36, a top side 50, and a second side 40. The first side 36 of the alarm housing 12 defines an opening 38 as shown in FIG. 5.

In the preferred embodiment, the opening 38 is dimensioned to have substantially the same cross-sectional dimensions as the first end 42 of strap 26. In an alternate embodiment, opening 38 is dimensioned to be any size which may accept the first end 42 of the strap 26.

A ratcheting mechanism 30 is attached to the second side 40 of the alarm housing 12 in the preferred embodiment as shown in FIGS. 1, 2, and 3. The ratcheting mechanism 30 is dimensioned so as to be wide enough to accept the strap 26. This ratcheting mechanism 30 is of conventional design, well known to those skilled in the art, and is used to take up the slack in the strap 26 after it is wrapped around the baggage 34. The ratcheting mechanism 30 also locks so that the strap 26 can not be given slack without the ratcheting mechanism 30 first being unlocked. This prevents the alarm strap for luggage 10 from being rendered useless simply because the strap 26 is slipped out of the ratcheting mechanism 30. It will be understood that, in an alternate embodiment, any conventional device used to secure, tighten, and lock the strap 26 may be used instead of the ratcheting mechanism 30.

Also in the preferred embodiment, the top side 50 of the alarm housing 12 carries a lock switch 24, as shown in FIGS. 1 and 2, which completes the alarm circuitry 14 when locked by the user. The lock switch 24 is preferably, as illustrated, a mechanical key lock like those already known. However, in alternate embodiments, the lock switch 24 is an electronic combination lock, a push-button lock, or any other type of conventional lock.

Figure 6:
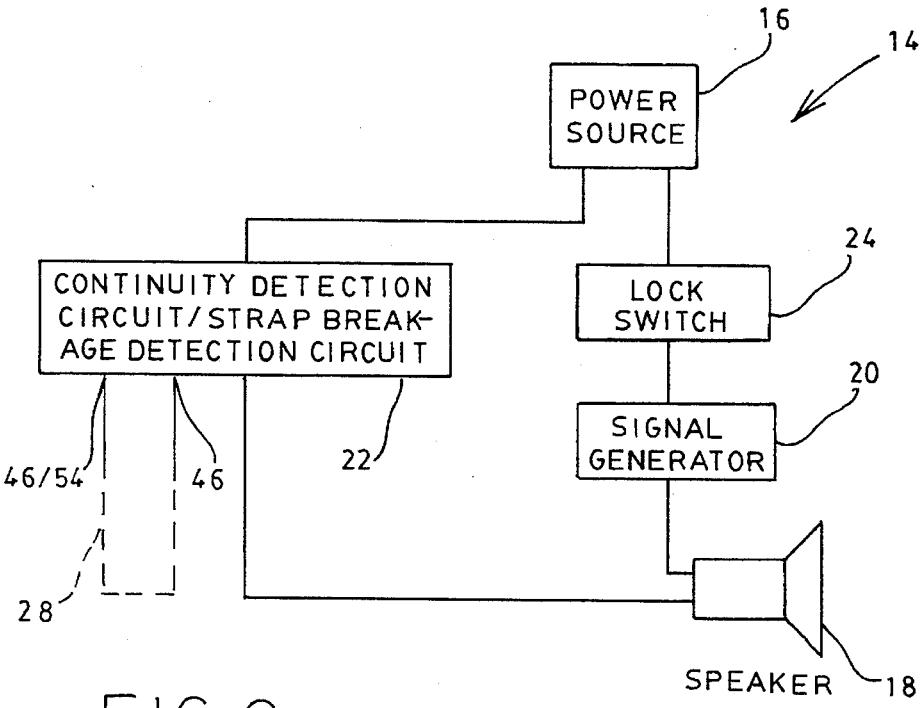
FIG. 6 illustrates a block diagram of the alarm circuitry carried in the alarm housing.
Figure 7:
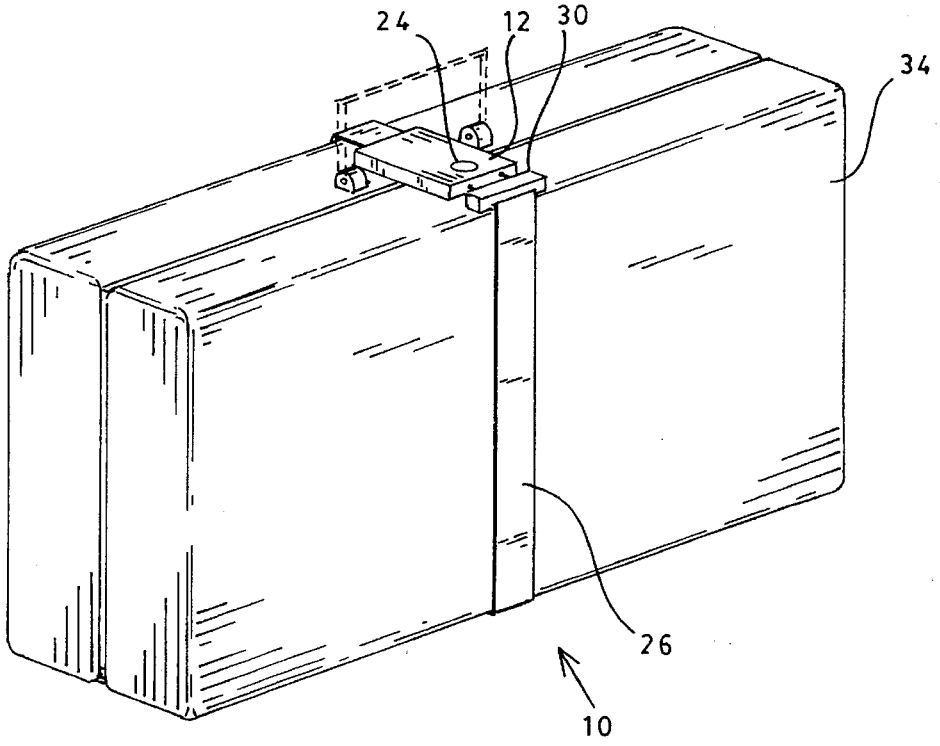
FIG. 7 illustrates a perspective view of the alarm strap for luggage secured to a piece of baggage.

The alarm circuitry 14 of the preferred embodiment comprises, at a minimum, a power source 16, a speaker 18, a signal generator 20, and a continuity detection circuit 22, all of which are connected in series, as shown in FIG. 6. The lock switch 24 described above is also connected in series with these elements.

The circuit of the continuity detection circuit 22 includes an electrically conductive element 28 carried by the strap 26 as shown in FIG. 4. This electrically conductive element 28 is a substantially wire-like element which is shaped like an elongated U. The two free ends 46 of the u-shaped electrically conductive element 28, in the preferred embodiment, extend slightly beyond the first end 42 of the strap 26 while the second end 48 of the u-shaped electrically conductive element 28 is the curved portion which extends almost to the second end 44 of the strap 26. The two free ends 46 of the electrically conductive element 28 are connected to and complete the continuity detection circuit 22. In an alternate embodiment, the electrically conductive element 28 is integrally formed with the strap 26. In yet another embodiment, there are two or more electrically conductive elements 28. In a third alternate embodiment, the second strap 32 may also carry one or more electrically conductive elements 28.

The preferred embodiment of the alarm strap for luggage 10 is made by inserting the first end 42 of strap 26 into the opening 38 in the first side 36 of the alarm housing 12. The free ends 46 of the electrically conductive element 28 are now inside the alarm housing 12. These free ends 46 are attached to the continuity detection circuit 22 so as to complete the circuit. This is done by any conventional method such as by soldering.

The preferred embodiment of the alarm strap for luggage 10 is then used by wrapping the strap 26 around the luggage. The second end 44 of the strap 26 is passed through the ratcheting mechanism 30 carried by the second side 40 of alarm housing 12. The user then ratchets down the strap 26 so that no slack remains and the strap 26 is taut against the baggage 34. The user then sets the lock switch 24 to the on position.

Figure 9:
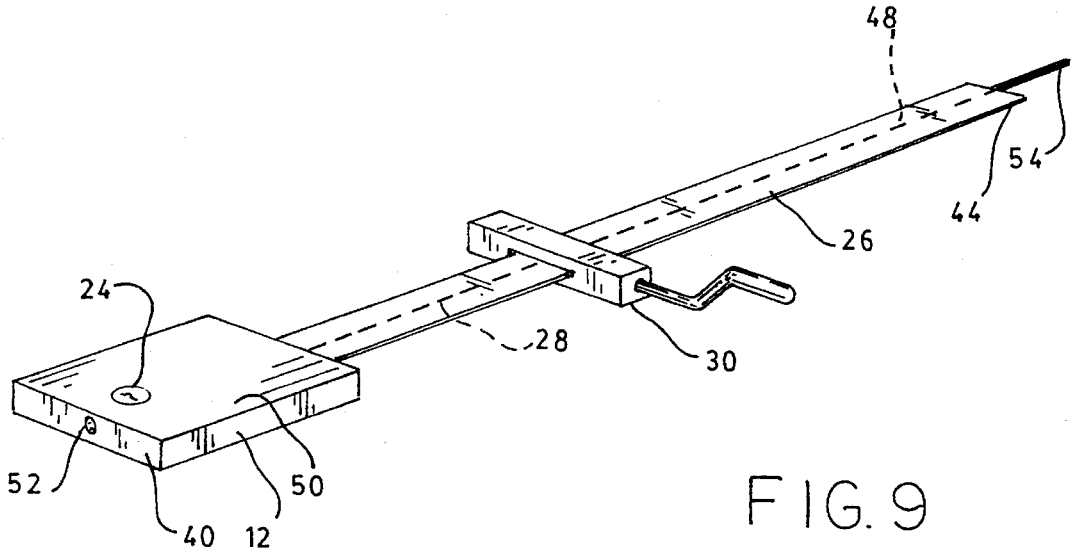
FIG. 9 illustrates a perspective view of an alternate embodiment of the alarm strap wherein an electrically conductive male member is secured to the electrically conductive member near the second end of the strap.

In an alternate embodiment of the present invention, the electrically conductive member 28 is fiber-like. In this embodiment, the second end 48 of the electrically conductive element 28 is secured to an electrically conductive male member 54, as shown in FIG. 9, in a manner which allows for the conduction of electricity from the electrically conductive element 28 to the male member 54. The second side 40 of the alarm housing 12 defines a second opening 52 which is dimensioned to closely accept the male member 54. The continuity detection circuit 22 is completed when the male member 54 is passed through the second opening 52, and the lock switch 24 is set to the on position by the user.

In this embodiment, the slack in the strap 26 is also taken up by a ratcheting mechanism 30. However, the ratcheting mechanism 30 is carried on the strap 26. In this embodiment, there may also be a second strap 32 as described above which may also carry one or more electrically conductive elements.

Once the alarm strap for luggage 10 is secured to the baggage 34 and armed, if the strap 26 breaks, the electrically conductive element 28 will also break, The cessation of current through the electrically conductive element 28 will signal the continuity detection circuit 22 that the strap 26 has been broken. The continuity detection circuit 22 then completes the alarm circuitry 14 circuit. When the alarm circuitry 14 is competed, the power source 16 energizes the signal generator 20 whose signal is made audible by the speaker 18.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. An alarm strap for luggage which secures around a piece of luggage and emits an audible alarm when unauthorized entrance to the luggage is attempted through breakage of said alarm strap for luggage, said alarm strap for luggage comprising:

a strap defining a first end and a second end;

alarm circuitry, including continuity detection circuitry, for sensing the breakage of any said strap, said alarm circuitry emitting the audible alarm upon sensing the breakage of said strap;

an electrically conductive element carried on said strap, said electrically conductive element having a first free end and a second free end, said first and second free ends connected into said continuity detection circuitry of said alarm circuitry, said electrically conductive element extending substantially the length of said strap and being broken by breakage of said strap;

an alarm housing defining a cavity for carrying said alarm circuitry, said alarm housing having a first side, a second side oppositely disposed to said first side, and a top side joining said first side to said second side, said first side provided with an opening dimensioned to accept said first free end of said strap into said alarm housing for attachment of at least one free end of said electrically conductive element to said continuity detection circuitry; and a mechanism attached to an exterior surface of said second side of said alarm housing for engagement with said second end of said strap for taking up any slack in said strap after said alarm strap for luggage has been placed around the piece of luggage.

2. The alarm strap for luggage of claim 1 wherein said electrically conductive element is substantially u-shaped and defines said first and second free ends and a curved portion intermediate said first and second free ends, said electrically conductive element dimensioned such that said first and second free ends extend beyond said first end of said strap for attachment into said continuity detection circuitry and said curved portion extends substantially to said second end of said strap.

3. The alarm strap for luggage of claim 1 wherein said electrically conductive element is a wire having a length dimension greater than a length dimension of said strap, said wire having a first free end extending beyond said first end of said strap for attachment into said continuity detection circuitry, and a second free end extending beyond said second end of said strap for attachment into said continuity detection circuitry.

4. The alarm strap for luggage of claim 1 wherein said top side of said alarm housing carries a lock switch for arming said alarm circuitry.

5. The alarm strap for luggage of claim 3 wherein said second free end of said electrically conductive element is provided with an electrically conductive male member, and wherein said second side of said alarm housing defines a second opening dimensioned so as to accept said male member for attachment into said continuity detection circuitry.

6. The alarm strap for luggage of claim 1 further comprising at least one second strap secured to said strap so as to be substantially perpendicular to said straps, said at least one second strap for encircling said luggage.

7. An alarm strap for luggage which secures around a piece of luggage and emits an audible alarm when unauthorized entrance to the luggage is attempted through breakage of said alarm strap for luggage, said alarm strap for luggage comprising:

a strap defining a first end and a second end;

an electrically conductive wire defining a first free end and a second free end, said electrically conductive wire being carried by said strap and extending substantially from said first end to said second end of said strap, said electrically conductive wire being broken upon breakage of said strap;

alarm circuitry, including continuity detection circuitry connected to said first and second free ends of said electrically conductive wire, for sensing the breakage of said strap, said alarm circuitry emitting the audible alarm upon sensing the breakage of said electrically conductive wire of said strap;

an alarm housing defining a cavity for carrying said alarm circuitry, said alarm housing having a first side, a second side oppositely disposed to said first side, and a top side joining said first and second sides, said first side of said alarm housing defining an opening dimensioned so as to accept said first end of said strap; and a ratcheting mechanism for taking up any slack in said strap after said alarm strap for luggage has been placed around the piece of baggage, said ratcheting mechanism being carried on an exterior surface of said second side of said alarm housing.

8. The alarm strap for luggage of claim 7 wherein said electrically conductive wire is substantially u-shaped and defines said first and second free ends and a curved portion intermediate said two free ends, said electrically conductive wire dimensioned such that said first and second free ends extend beyond said first end of said strap and said curved portion extends substantially to said second end of said strap, said free ends of said electrically conductive wire being secured into said continuity detection circuitry of said alarm circuitry such that, when said electrically conductive wire is broken, the cessation of current in said electrically conductive wire inactivates said continuity detection circuitry and causes said alarm circuitry to emit the audible alarm.

9. The alarm strap for luggage of claim 8 wherein said top side of said alarm housing carries a lock switch for arming said alarm circuitry.

10. The alarm strap for luggage of claim 9 further comprising at least one second strap secured to said strap so as to be substantially perpendicular to said strap.

11. An alarm strap for luggage which secures around a piece of luggage and emits an audible alarm when unauthorized entrance to the luggage is attempted through breakage of said alarm strap for luggage, said alarm strap for luggage comprising:

a strap defining a first end and a second end;

an electrically conductive wire defining a first free end and a second free end, said electrically conductive wire being carried by said strap and extending substantially between said first and second ends of said strap;

alarm circuitry, including continuity detection circuitry, for sensing the breakage of said strap, said alarm circuitry emitting the audible alarm upon sensing the breakage of said electrically conductive wire of said strap;

an alarm housing defining a cavity for carrying said alarm circuitry, said alarm housing having at least a first side, a second side oppositely disposed to said first side, and a top side joining said first and second sides, said first side of said alarm housing defining an opening dimensioned so as to accept said first end of said strap for attachment of said first free end of said electrically conductive wire into said continuity detection circuitry, said second side of said alarm housing defining a second opening for receiving said second free end of said electrically conductive wire for attachment into said continuity detection circuitry;

a lock switch for arming said alarm circuitry carried on said top side of said alarm housing; and a ratcheting mechanism for taking up any slack in said strap after said alarm strap for luggage has been placed around the piece of luggage, said ratcheting mechanism being carried on an exterior surface of said second side of said alarm housing.

12. The alarm strap for luggage of claim 11 further comprising an electrically conductive male member connected to said second free end of said electrically conductive wire and dimensioned so as to be accepted by said second opening of said alarm housing so as to be connected into said continuity detection circuitry.

13. The alarm strap for luggage of claim 11 further comprising at least one second strap secured to said strap so as to be substantially perpendicular to said strap.

* * * * *